United States Patent [19]

Groenewegen

[11] Patent Number: 4,616,682

[45] Date of Patent: Oct. 14, 1986

[54] METHOD OF MANUFACTURING HELICALLY WOUND FILAMENTS AND FILAMENTS MANUFACTURED BY MEANS OF THIS METHOD

[75] Inventor: Martinus A. Groenewegen, Eindhoven, Netherlands

[73] Assignee: U.S. Philips Corporation, New York, N.Y.

[21] Appl. No.: 681,471

[22] Filed: Dec. 13, 1984

[30] Foreign Application Priority Data

Jan. 13, 1984 [NL] Netherlands ..... 8400117

[51] Int. Cl.[4] ..... B21F 45/00

[52] U.S. Cl. ..... 140/71.5; 72/144

[58] Field of Search ..... 140/71.5, 71.6; 29/618; 72/66, 142, 143, 144

[56] References Cited

U.S. PATENT DOCUMENTS 3,031,006 4/1962 Fokkinga ..... 72/144

4,408,639 10/1983 Hayama et al. ..... 140/71.5

*Primary Examiner*—Francis S. Husar

*Assistant Examiner*—Robert Showalter

*Attorney, Agent, or Firm*—David R. Treacy

[57] ABSTRACT

A plurality of filaments are helically wound on a mandrel, with longitudinal portions being formed between the last turn of one and the first turn of the next filament. Winding stresses are removed from a preceding wound filament by heating it. That filament is anchored on the mandrel by the heating step, and the next filament is then wound as similarly freed from winding stress. The mandrel is then drawn out of the preceding filament and is displaced through the next subsequent filament while the mandrel is rotated in a direction opposite that used for winding. The filaments are then separated.

4 Claims, 1 Drawing Figure

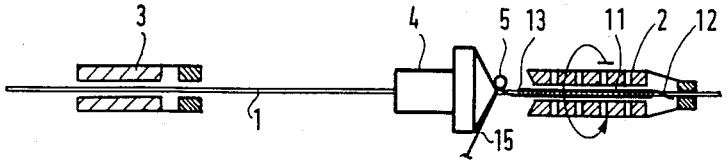
Fig. 1a
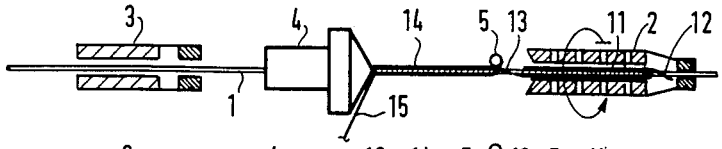
Fig. 1b
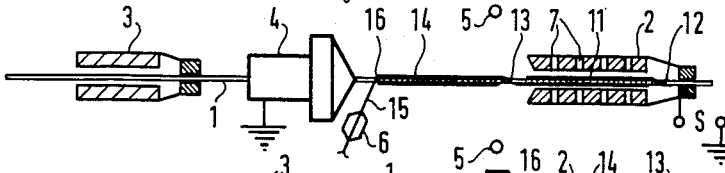
Fig. 1c
Fig. 1d
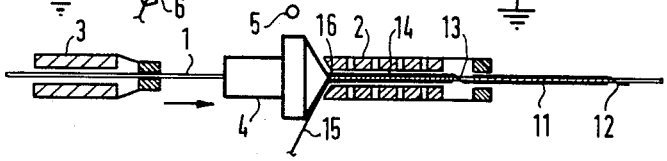
Fig. 1e
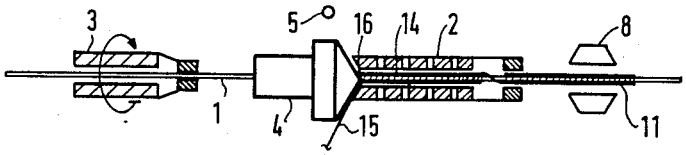
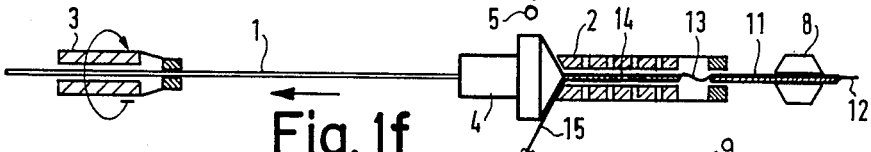
Fig. 1f
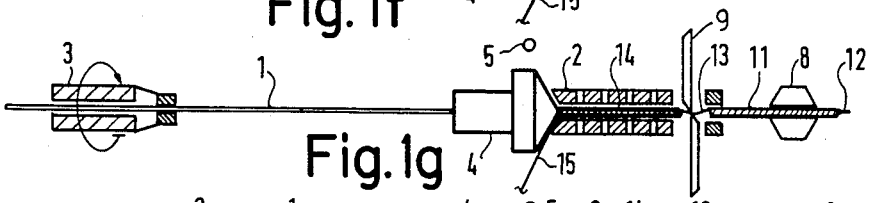
Fig. 1g
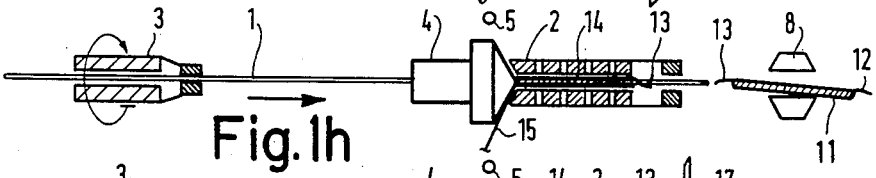
Fig. 1h
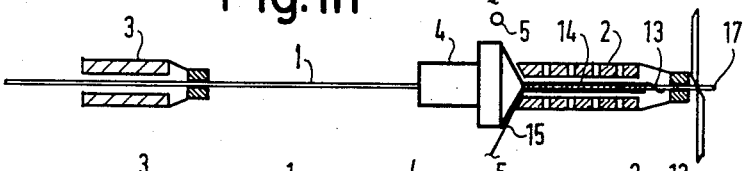
Fig. 1i
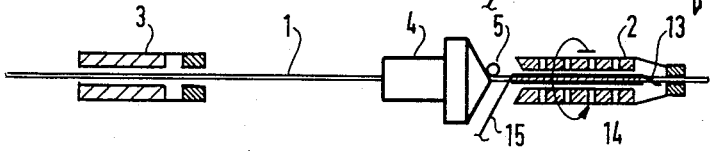
Fig. 1j

METHOD OF MANUFACTURING HELICALLY WOUND FILAMENTS AND FILAMENTS MANUFACTURED BY MEANS OF THIS METHOD

BACKGROUND OF THE INVENTION

The invention relates to a method of manufacturing helically wound filaments, in which a filament wire is helically wound on a mandrel, the helically wound wire is heated while being held on the mandrel so that winding stresses in the wire are eliminated, and the mandrel is drawn out of the filament. Such a method is known from Dutch Patent Specification No. 17928 (Patent Treuhand, Mar. 15th, 1926).

This Dutch Patent Specification states that the step of drawing the mandrel out of the filament is an alternative to removing the mandrel by dissolving it. The step of removing the mandrel by drawing it out of the filament is attractive because the formation of large quantities of solution of mandrel material is not involved.

In order to obtain light sources of high quality, it is necessary that the filament has a substantially elongate filament wire portion on each side of the wound filament. For several lamp types it is necessary that these elongate portions are in line with the filament and consequently extend at least substantially longitudinally with respect to the mandrel during the manufacture of the filament. Such filaments cannot be manufactured by means of the method known from the above Dutch Patent Specification.

SUMMARY OF THE INVENTION

The invention has for its object to provide a filament winding method of the kind described above, in which filaments of high quality having at their ends elongate filament wire portions in line with the filament can be manufactured, and in which the mandrel may be used repeatedly for winding filaments. The method should be suitable for automatic manufacturing.

According to the invention, a method of the kind described above is characterized in that a plurality of filaments are wound from one filament wire, with a filament wire portion extending substantially longitudinally with respect to the mandrel being formed each time between a preceding filament and the next subsequent filament, winding stresses in the next subsequent filament and in the filament wire portion between that next subsequent filament and the preceding filament are eliminated by heating, while the filament wire extending to said next subsequent filament is kept stretched and the preceding filament is kept cool, subsequently, while the mandrel and the filaments are relatively rotated about their axes in a sense opposite to the winding sense, and that next subsequent filament is held at its last-formed end, the mandrel is drawn out of the preceding filament and is displaced through said next subsequent filament, the connection between the preceding and said next subsequent filament is interrupted at the longitudinal filament wire portion, and the mandrel is moved back beyond the free end of said filament wire portion.

By means of the method according to the invention, filaments of high quality are be manufactured for use in various applications, such as (halogen) incandescent lamps in mixed light lamps (lamps having as light sources a gas discharge and a filament which serves at the same time as a current limiter for the gas discharge) and as electrodes in discharge lamps, for example low-pressure sodium and low-pressure mercury discharge lamps. The filaments can be single coiled bodies or coiled coil bodies. The term "filament wire" designates in the former case a straight wire and in the latter case a wire helically wound on a primary mandrel. The straight wire and the helically wound wire usually consist of tungsten, while the primary mandrel consists of a less noble metal, such as iron or molybdenum, which can be removed by etching after the manufacturing of the filament. The method is well suitable to be used in automatic manufacturing.

In the case of a coiled coil (cc) filament, the expression "a filament wire portion extending substantially longitudinally with respect to the mandrel" is to be understood to mean a single coil portion helically wound on a primary mandrel and extending substantially longitudinally with respect to the mandrel on which the filament is formed in the method according to the invention.

The method according to the invention could not be realized before several problems were solved, of which a few will be mentioned here.

For example, the manner in which the beginning of a filament is fixed on the mandrel, and held there until winding stresses are eliminated therefrom, is achieved in the method according to the invention during the manufacture of each subsequent filament by use of the preceding filament still present on the mandrel. This preceding filament has already been thermally treated, has lost its winding stresses during this treatment and is thus anchored on the mandrel.

The mandrel has to be retracted from the preceding filament and be displaced through the next subsequent filament. However, these filaments have been thermally treated, and have consequently shrunk and thus obtained a large frictional resistance with the mandrel. In order to reduce the frictional resistance, the mandrel is rotated in a sense opposite to the winding sense, while the next subsequent filament is held at its last-formed end.

In spite of this reduced frictional resistance, pitch variations occur during the displacements of the mandrel through a filament. For the preceding filament, from which the mandrel is removed, this pitch variation is of no importance. As soon as the mandrel has been removed, that filament springs back into its original position. However the "next-subsequent filament" remains on the mandrel until the next following filament has been wound and thermally treated. During this following thermal treatment, the pitch variation in the "next subsequent filament" would be fixed. This filament is therefore kept cool so that, when the mandrel is eventually removed from it, it springs back into its original shape.

Heating of filaments for eliminating winding stresses can be effected by means of an external heat source, for example a laser or a high-frequency field.

A preferred alternative, however, is heating by current passage. However, if the connection terminals of the current source are placed on the filament which has to be relieved, this filament is not heated sufficiently at the area of these terminals to eliminate winding stresses, due to heat dissipation through these terminals. Therefore, the connection terminals should be arranged laterally of this filament. However, the preceding filament is situated on one side of this filament. If a connection terminal should be placed on this preceding filament, this could lead to damage. Moreover, if the connection terminals are placed at areas of the mandrel which are not wound around so that current flows through the mandrel portion on which the preceding filament and the next subsequent filament are situated, this preceding filament is also heated and undesired pitch variations therein, which are due to the displacements of the mandrel therein, are fixed.

In a further preferred embodiment, in which winding stresses are eliminated by passage of current through the mandrel, heating takes place by passage of current through the mandrel portion which extends through the preceding filament and the next subsequent filament, while the connection terminals of the current source are situated at areas of the mandrel which are not wound. The preceding filament is kept cool, that is at a temperature below the temperature at which stresses are eliminated. Keeping the preceding filament cool also has the advantageous consequence that its electrical resistance remains low and that only a small quantity of electrical energy is thus dissipated therein. For keeping the preceding filament cool, use may be made, for example, of a flow of non-oxidizing gas, such as a mixture of 7% by volume of hydrogen and 93% by volume of nitrogen.

In another embodiment of the method, the mandrel is periodically moved further in the direction of the filament and a part of the mandrel is removed at the end adjacent this filament. This measure results in a smaller spread of the diameter of the filaments due to wear of the mandrel.

BRIEF DESCRIPTION OF THE DRAWING

An embodiment of the method according to the invention is shown diagrammatically in the drawing. In the drawing, each of the figures shows a processing step or the result thereof. Like parts are designated by the same reference numerals.

DESCRIPTION OF THE PREFERRED EMBODIMENT

In FIG. 1*a*, a mandrel 1 extends through a winding head 2, a release head 3 and a winding guide 4. A transversely movable pin 5 crosses the winding mandrel 1. The winding mandrel 1 consists of a metal which is capable of withstanding the temperature of the thermal treatment of the filaments, for example of iron, molybdenum, tungsten or tungsten/rhenium.

There is shown on the winding mandrel 1 a preceding filament 11 which has at both ends a filament wire portion 12 and 13, respectively, extending substantially longitudinally with respect to the mandrel 1. The filament wire from which the filaments are wound is designated by reference numeral 15 and is shown for the sake of clarity as a single straight wire, but may also designate a primary mandrel of, for example, molybdenum, which is helically wound with a wire of, for example, tungsten.

The winding head 2 is set into rotation in the indicated direction and the mandrel 1 is taken along.

In FIG. 1*b*, the last winding of the next subsequent filament 14 has been provided.

In FIG. 1*c*, the filament wire 15, which extends to the filament 14, is kept stretched by a pair of tongs 6. While inert gas is blown through the winding head 2 to the inside via ducts 7 in order to keep the filament 11 cool, a current source is applied across the winding head 2 and the winding hose 4, as a result of which a current starts to flow through the mandrel portion extending through the preceding filament 11 and the next subsequent filament 14. This current heats the filament 14 so that winding stresses in this filament and in the filament wire portion 13 extending longitudinally with respect to the mandrel 1 are eliminated. The temperature of the filament 14 then reaches a value lying between approximately 1900° and 2200° C. The connection terminals of the current source engage areas of the mandrel 1 which are free of filament windings.

In FIG. 1*d*, the mandrel 1, with the filaments 11,14 wound thereon, is moved on with respect to the winding head 2 and the winding guide 4 holds the filament 14 at its last-formed end 16.

In FIG. 1*e*, the release head 3 rotates with respect to the filaments 11,14 in a sense opposite to the winding sense whilst taking along the mandrel 1, as a result of which the filaments 11, 14 are released from the mandrel 1.

In FIG. 1*f*, the release head 3 draws the mandrel 1 out of the filament 11, which is then supported by a pair of tongs 8, while the filament 14 is displaced over the mandrel.

In FIG. 1*g*, the longitudinally extending filament wire portion 13 is cut through by cutters 9 in order to separate the filaments.

In FIG. 1*h*, the mandrel 1 is moved back in order that it can be gripped by the winding head 2. The winding head grips the mandrel 1 only so that the filament 14 is not damaged.

Also indicated in this figure, is a measure taken periodically, but not necessarily in each cycle, which involves moving the mandrel 1 over a certain distance further in the direction of the filament 14 in order to permit the removal, as shown diagrammatically in FIG. 1*i*, of a portion thereform at the end 17 adjacent this filament.

In FIG. 1*j*, the pin 5 is arranged so as to cross the mandrel 1 and the winding head 2 starts to rotate in order to manufacture a second longitudinal portion of the filament 14.

The product then obtained corresponds to that shown in FIG. 1*a*.

What is claimed is:

1. A method of manufacturing helically wound filaments, comprising the steps of winding a filament wire on a mandrel, heating the helically wound wire while holding it on the mandrel so that winding stresses in the wire are eliminated, and drawing the mandrel out of the filament, characterized by:

winding a plurality of filaments from one filament wire, while forming a filament wire portion between each preceding filament and the next subsequent filament, extending substantially longitudinally with respect to the mandrel, heating said next subsequent filament to eliminate winding stresses therein and in said portion between said next subsequent filament and the preceding filament, while keeping the preceding filament cool and the filament wire extending to said next subsequent filament stretched, then, while relatively rotating the mandrel and the filaments about their axes in a sense opposite to the winding sense, and holding the next subsequent filament at its last-formed end, drawing the mandrel out of the preceding filament and displacing the mandrel through said next subsequent filament, interrupting the connection between the preceding filament and said next subsequent filament wire portion at the longitudinal filament wire portion, and moving the mandrel back beyond the free end of said filament wire portion.

2. A method as claimed in claim 1, wherein the step of heating the helically wound wire while holding it on the mandrel is performed by passing a current through the mandrel, characterized by applying connection terminals of a current source at areas of the mandrel free from winding, arranged such that current passing between the connection terminals flows through the mandrel portion which extends through the preceding filament and said next subsequent filaments.

3. A method as claimed in claim 2, characterized in that said step of moving the mandrel back also includes, periodically, moving the mandrel over a given distance further in the direction of the filament; and the method also includes shortening the mandrel at an end adjacent the filament.

4. A method as claimed in claim 1, characterized in that said step of moving the mandrel back also includes, periodically, moving the mandrel over a given distance further in the direction of the filament; and the method also includes shortening the mandrel at an end adjacent the filament.

* * * * *